US006354181B1

(12) United States Patent
Donovan

(10) Patent No.: US 6,354,181 B1
(45) **Date of Patent: *Mar. 12, 2002**

(54) METHOD AND APPARATUS FOR THE DESTRUCTION OF SUSPECTED TERRORIST WEAPONS BY DETONATION IN A CONTAINED ENVIRONMENT

(76) Inventor: John L. Donovan, P.O. Box 486, Danvers, IL (US) 61732

( * ) Notice: Subject to any disclaimer, the term of this patent is extended or adjusted under 35 U.S.C. 154(b) by 0 days.

This patent is subject to a terminal disclaimer.

(21) Appl. No.: 09/457,976

(22) Filed: Dec. 9, 1999

Related U.S. Application Data

(63) Continuation-in-part of application No. 09/191,045, filed on Nov. 12, 1998, now Pat. No. 6,173,662, which is a continuation-in-part of application No. 08/823,223, filed on Mar. 24, 1997, now Pat. No. 5,884,569, which is a continuation-in-part of application No. 08/578,200, filed on Dec. 29, 1995, now Pat. No. 5,613,453.

(51) Int. Cl.[7] ..... F42B 33/00
(52) U.S. Cl. ..... 86/50; 110/237; 588/202
(58) Field of Search ..... 86/49, 50; 588/202, 588/203; 110/203, 237, 242

(56) References Cited

U.S. PATENT DOCUMENTS

| | | | | |
|---|---|---|---|---|
| 3,408,432 A | | 10/1968 | Tumm et al. | |
| 3,464,249 A | | 9/1969 | Klein | |
| 3,485,075 A | | 12/1969 | Kiselev et al. | |
| 3,611,766 A | | 10/1971 | Klein et al. | |
| 3,721,201 A | | 3/1973 | Boller | |
| 3,793,101 A | | 2/1974 | Mullarkey | |
| 3,800,715 A | * | 4/1974 | Boller | 109/49.5 |
| 3,800,716 A | | 4/1974 | Berger | |
| 3,903,814 A | | 9/1975 | Altekruse | |
| 3,910,084 A | | 10/1975 | Paton et al. | |

(List continued on next page.)

FOREIGN PATENT DOCUMENTS

| | | |
|---|---|---|
| EP | 0315616 | 5/1989 |
| FR | 2608268 | 6/1988 |

OTHER PUBLICATIONS

"USSR," 1995—Palamarchuk, Malakhov, Cherkashin, and Petushkov; Abstract for: Shock Waves and Their Suppression by Foam In Explosive Treatment of Welded Joints; Jan., 1995 (Abstract Only).

Joe Serena "Blast containment structure passes proof test" *Ordnance Explosives Environment*, Apr.–Jun. 1996.

Joseph M. Serena "Development of an On–Site Demolition Container for Unexploded Ordnance" presented at the Global Demilitarization Symposium and Exposition, May 13–17, 1996.

*Primary Examiner*—Harold J. Tudor
(74) *Attorney, Agent, or Firm*—Bullwinkel Partners, Ltd.

(57) ABSTRACT

An apparatus and method for the destruction of terrorist weapons, including explosives chemical and biological agents, by detonation in an enclosed double-walled steel explosion chamber having its walls, access door and floor filled with granular shock damping material. The chamber is vented through orifices into vent pipes which converge in a manifold which exhausts into an expansion tank or scrubber for cooling, testing, and environmental treatment of the explosion products. A weapon to be destroyed is placed into the chamber with a donor explosive charge and held in place by a disintegratable string hammock, along with one or more plastic polymer film bags containing water. After closing the access door, the donor charge is detonated by an electrical detonation means. For use in destroying known or suspected chemical or biological weapons the donor charge is augmented with an oxidizing material such as potassium nitrate, and the resulting fireball is enhanced by powdered metal such as aluminum, to achieve an instantaneous pressure of 100 kilobars and instantaneous temperature of 3,000 degrees Celsius.

27 Claims, 3 Drawing Sheets

U.S. PATENT DOCUMENTS

| | | | | |
|---|---|---|---|---|
| 3,915,104 | A | | 10/1975 | Hapgood et al. |
| 4,027,601 | A | | 6/1977 | Hickerson |
| 4,079,612 | A | | 3/1978 | Smirnov et al. |
| 4,081,982 | A | | 4/1978 | Minin et al. |
| 4,085,883 | A | | 4/1978 | Deribas et al. |
| 4,100,783 | A | | 7/1978 | Gambarov et al. |
| 4,174,624 | A | | 11/1979 | Shrum |
| 4,248,342 | A | | 2/1981 | King et al. |
| 4,325,309 | A | | 4/1982 | King et al. |
| 4,478,350 | A | | 10/1984 | Ohlsson |
| 4,632,041 | A | | 12/1986 | Ohlson |
| 4,686,911 | A | | 8/1987 | Phillips |
| 4,781,145 | A | | 11/1988 | Amlinsky et al. |
| 4,836,079 | A | | 6/1989 | Barrett |
| 4,875,420 | A | | 10/1989 | Hay et al. |
| 4,879,890 | A | | 11/1989 | Hardwick |
| 5,044,252 | A | | 9/1991 | Gamadi et al. |
| 5,339,666 | A | | 8/1994 | Suzuki et al. |
| 5,419,862 | A | | 5/1995 | Hampel |
| 5,458,071 | A | | 10/1995 | Tadmor et al. |
| 5,495,812 | A | | 3/1996 | Schulze |
| 5,613,453 | A | | 3/1997 | Donovan |
| 5,668,342 | A | | 9/1997 | Discher |
| 5,792,978 | A | | 8/1998 | Woodall, Jr. et al. |
| 5,875,996 | A | | 3/1999 | Borgia |
| 5,884,569 | A | | 3/1999 | Donovan |
| 5,884,709 | A | | 3/1999 | Evans et al. |
| 5,997,668 | A | * | 12/1999 | Aubert et al. ..... 149/92 |
| RE36,912 | E | * | 10/2000 | Donovan ..... 86/50 |
| 6,173,662 | B1 | * | 1/2001 | Donovan ..... 86/50 |

* cited by examiner

METHOD AND APPARATUS FOR THE DESTRUCTION OF SUSPECTED TERRORIST WEAPONS BY DETONATION IN A CONTAINED ENVIRONMENT

I, John L. Donovan, have invented certain new and useful improvements in a METHOD AND APPARATUS FOR THE DESTRUCTION OF SUSPECTED TERRORIST WEAPONS BY DETONATION IN A CONTAINED ENVIRONMENT of which the following is a specification. This application is a continuation-in-part of my application Ser. No. 09/191,045 filed Nov. 12, 1998 now U.S. Pat. No. 6,173,662. Application Ser. No. 09/191,045 is also a continuation-in-part of application Ser. No. 08/823,223 filed Mar. 24, 1997 which issued as U.S. Pat. No. 5,884,569 on Mar. 23, 1999. Application Ser. No. 08/823,223 is also a continuation-in-part of application Ser. No. 08/578,200 filed Dec. 29, 1995, which issued as U.S. Pat. No. 5,613,453 on Mar. 25, 1997.

FIELD OF THE INVENTION

This invention relates to a method and apparatus for containing, controlling and suppressing the detonation of explosives, particularly for the on-site destruction and disposal of terrorist weapons such as package bombs, including weapons which are known or suspected to contain chemical or biological warfare agents.

BACKGROUND OF THE INVENTION

It is therefore the principal object of the present invention to provide an improved method and apparatus for containing, controlling and suppressing the effects of explosive detonations, particularly those detonations resulting from the destruction of suspected package bombs and similar terrorist devices. The purpose of the invention is to provide a containment device which can contain and suppress the explosion and its explosion products so that it poses no hazard to surrounding plant and equipment, or to the environment.

A further object is to provide a compact and readily portable device to enable appropriate military or law enforcement authorities to safely destroy not only devices suspected of containing explosives, but also devices suspected of containing a combination of explosives and toxic chemicals and/or biological warfare ("CBW") agents.

SUMMARY OF THE INVENTION

The improved explosion chamber of the invention comprises a double-walled steel explosion chamber with hollow walls, ceiling and floor. These cavities are filled with granular shock damping material such as silica sand. The floor of the chamber is covered with a bed of granular shock-damping such as pea gravel.

On the outside of the chamber are steel manifolds from which a linear array of vent pipes penetrates the double walls of the chamber, with each pipe having at its entrance end a protected hardened steel orifice through which the explosion combustion products pass before being vented through the pipes into the manifolds.

In use, a known or suspected explosive or CBW weapon is placed in the chamber with an initiating explosive or "donor charge", and the weapon and donor charge are suspended at approximately the midpoint of the chamber in harness or net made of material which will substantially disintegrate in the following explosion. The donor charge is fitted with detonation means such as an electrical blasting cap connected to an outside source of initiation energy by fine wires or other suitable means. Also placed within the chamber, around and in proximity to the explosives, are plastic film bags filled with water which have the effect of tempering and moderating the effects of the detonation.

After detonation, the explosion products are vented through the orifices and vent pipes into the manifolds, from which they are directed into a treatment device such as a scrubber before being released to the atmosphere.

The method of operation of the invention comprises the steps of suspending a known or suspected explosive or CBW device at approximately the midpoint of the chamber in a harness or net of disintegratable material, positioning plastic bags containing an amount of water approximating the weight of explosive near the explosive, attaching a detonation initiation device to the donor charge, closing the access door to seal the chamber against venting directly to the atmosphere, detonating the explosives, and controlling the release of the explosion products through the vent pipes into the manifolds, and then holding, testing and treating the explosion products until they can be safely released into the environment.

Another important feature of the invention is that for use in destroying known or suspected CBW agents, a the donor charge consists of a specially formulated plastic bonded explosive containing added oxygen-enrichment and fireball-enhancing ingredients to assure the complete destruction of all CBW agents with a minimum quantity of explosive material.

A BRIEF DESCRIPTION OF THE DRAWINGS

DETAILED DESCRIPTION OF THE INVENTION

Figure 1:
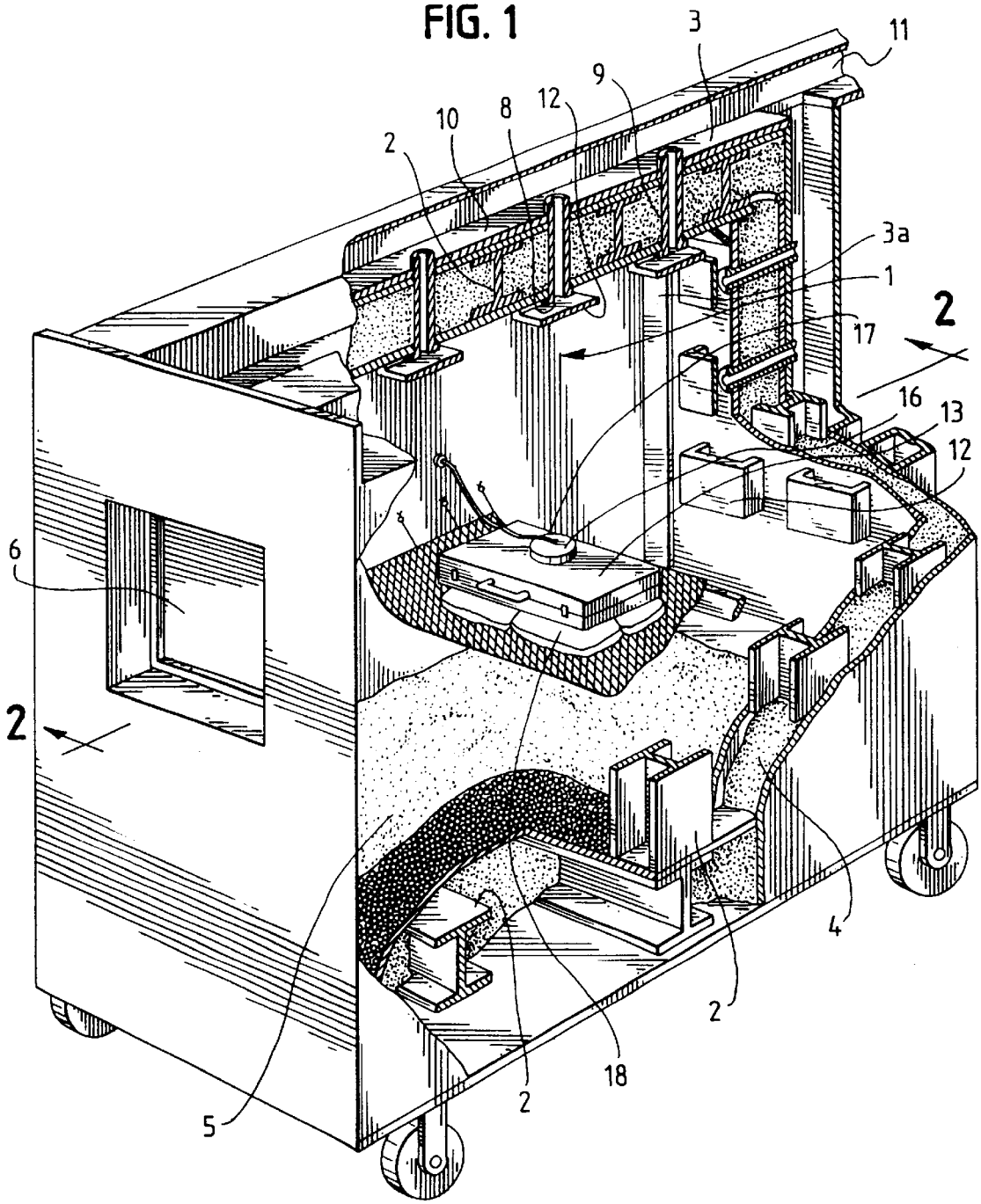
FIG. 1 is a cut-away perspective view of the improved explosion containment chamber of the present invention.
Figure 2:
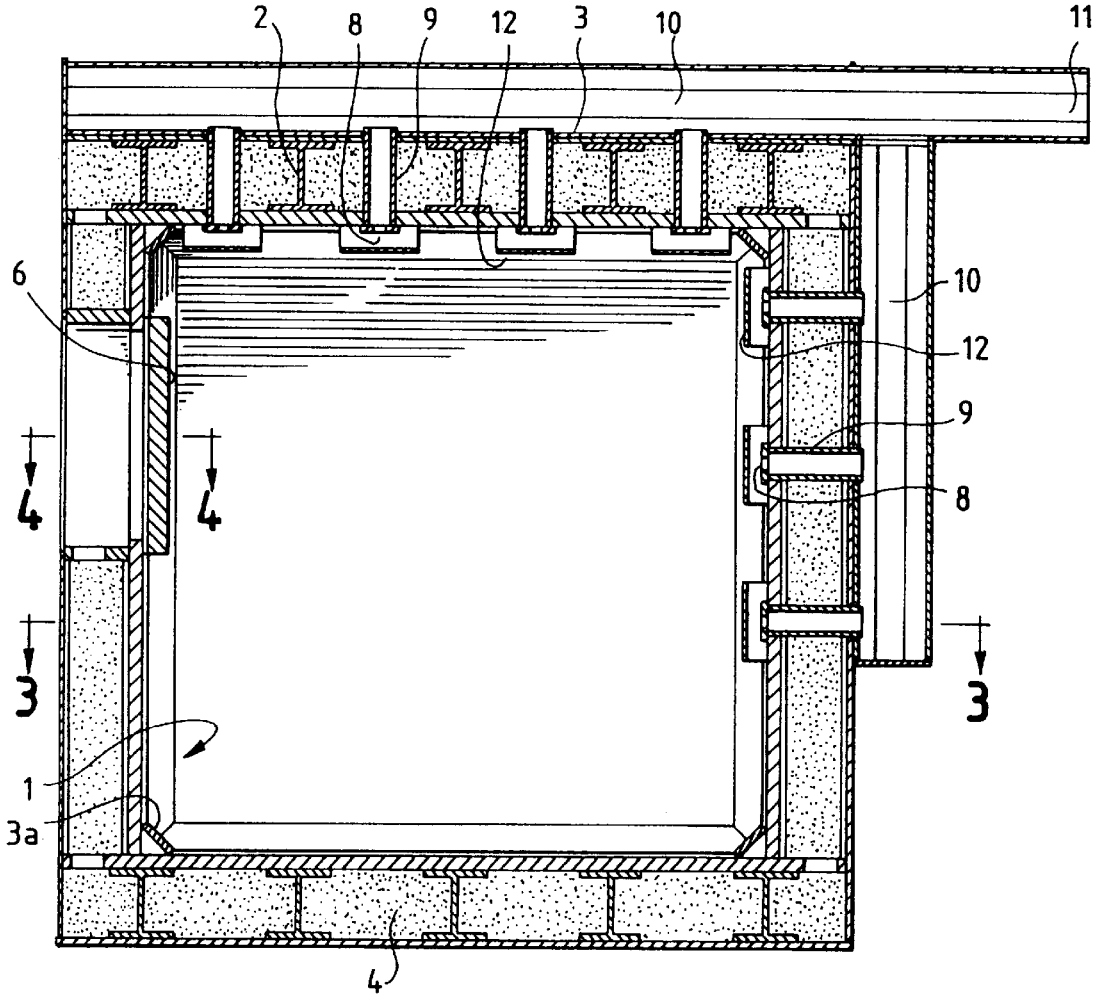
FIG. 2 is a sectional side elevation of the explosion chamber of the preceding figures.
Figure 3:
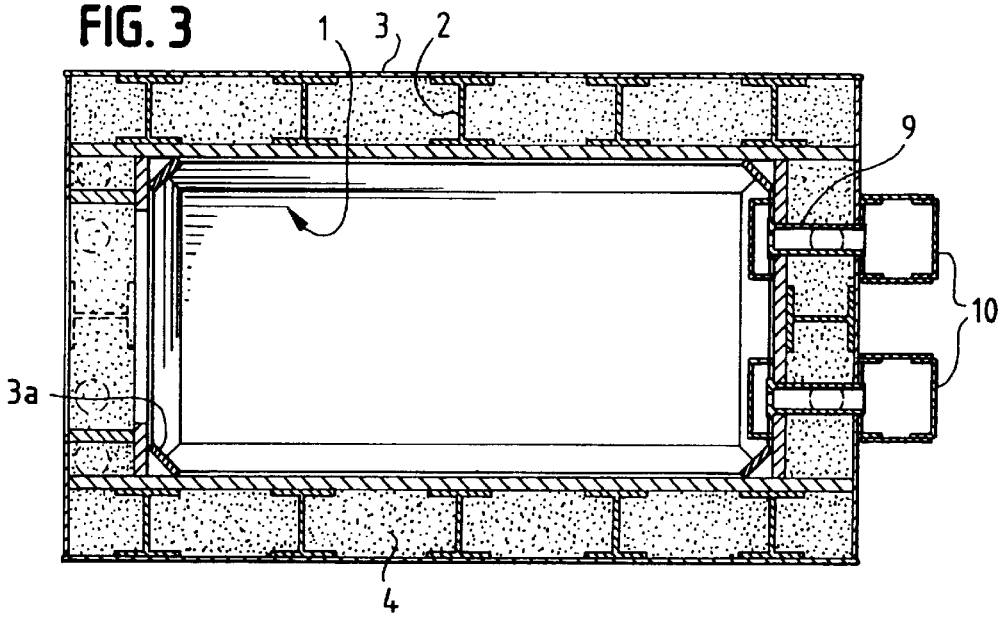
FIG. 3 is a sectional plan view of the explosion chamber of the preceding figures.
Figure 4:
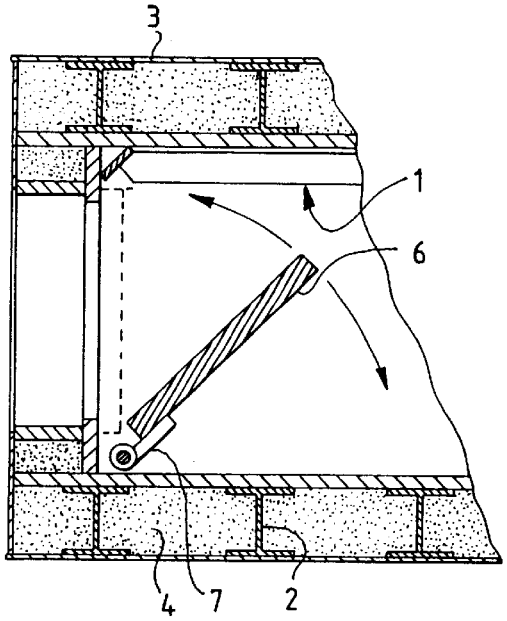
FIG. 4 is a partial sectional plan view of the inward-hinged self-tightening door of the explosion chamber of the preceding figures.

Turning to the drawings, FIG. 1 is a sectional perspective of the improved explosion chamber of the present invention. The chamber comprises an inner casing 1 having a ceiling, floor, side walls and ends, being fabricated of sheet steel using conventional welding techniques. Surrounding the inner casing 1 are a plurality of spaced circumstantial flanges or ribs 2 over which a welded sheet steel outer casing 3 is constructed so that the ribs 2 cause the outer casing 3 to be spaced from the inner casing 1 and leaving a gap which is then filled with a granular shock-damping material.

In the preferred embodiment, which is particularly adapted for the destruction of known or suspected small explosive or CBW devices, the inner and outer metal casings are constructed of one-half inch thick sheet steel separated by circumferential steel I-beam ribs 2 spaced on twelve inch centers. All seams are continuous-welded. Within the chamber, all open inside corners are fitted with welded fillet plates 3*a* to break the 90° square corner into two 45° angles, which has the effect of rounding the corner and eliminating stress-raising corners or pockets which would otherwise impose undesirable destructive forces on the corner welds. Square corners are to avoided because of the tendency of explosive detonations to exert unusually high stresses at such points.

According to the invention, the space between the inner and outer casing 3 is filled with a firm, granular shock-absorbing material 4, preferably silica sand. Also, the floor of the chamber is covered to an even depth with a layer 5 (FIG. 1) of granular shock-absorbing material such as pea gravel.

In the preferred embodiment shown, the dimensions of the explosion chamber are:

| INTERNAL DIMENSIONS | EXTERNAL DIMENSIONS |
|---|---|
| Width: 21.5 inches | Width: 37.25 inches |
| Length: 48.0 inches | Length: 61.25 inches |
| Height: 48.0 inches | Height: 66.5 inches |

The door opening in the illustrated embodiment is 16.0×16.0 inches square, with an 18.0×18.0 inch square door overlapping the edges of the opening by one inch on all sides. The door of the illustrated embodiment is solid, being made of 0.75 inch thick solid steel plate, though it could also be hollow and filled with granular shock-damping material as taught in my U.S. Pat. No. 5,613,453. The fillet plates or the illustrated embodiment are one-half inch steel, 3.0 inches wide.

The access door 6 is supported to swing open inwardly by internal hinges 7. A close seal is desirable, which may be achieved in any suitable way, such as by applying a strip of heat-resistant gasket material, such as room temperature vulcanizing (RTV) silicone rubber (not shown), or by simply by fitting the door to the door frame using extremely close tolerances. In either case, when the door is closed against its frame, the pressure of an explosion within the chamber tends to press the door more firmly against the frame, sealing it more tightly.

When an explosive is detonated in the chamber, the explosion products are released in a controlled manner through plurality of openings created by orifices 8, each of which is connected by a vent pipe 9, to manifolds 10 which run along the top and back of the chamber, and come together at an exhaust vent 11 located at the opposite end from the door 6. In the illustrated embodiment, each orifice is 1.0 inch in diameter, and has a U-shaped guard plate 12 welded over it to protect it from being chipped or broken off in use, while still allowing explosion products to be controllably vented off into the manifolds 10 and out the exhaust vent 11.

As is best shown in FIG. 1, an weapon to be destroyed 13 is introduced into the chamber through the door 5 and suspended at approximately midpoint of the chamber, above the layer of pea gravel 5 covering the floor, in support means preferably consisting a net or sling 14. According to the invention, the net or sling 14 is made of a material which substantially disintegrates in the detonation, leaving very little or no debris or residue. In the preferred embodiment, a cotton string net has proven satisfactory, although nets or containers made of other disintegratable materials will also serve, such as polymer monofilament or fine metal wire. Alternatively, the weapon 13 could be supported in a paper or cloth bag suspended from the ceiling of the chamber by a string or wire (not shown).

After the weapon 13 is positioned within the chamber, it is fitted with means for destruction by detonation, comprising of a suitable explosive donor charge 16, ignition means such as an electrically triggered blasting cap 17 with wire leads leading through a pressure-sealed opening in the chamber wall, and an energy absorption module 18 preferably consisting of a plastic bag filled with a measured amount of water. It has been discovered that commercially available "ZipLock" brand sandwich bags, six by eight inches in dimension and 0.002 inches (two mils) thick are satisfactory for this purpose. While water is preferable, any suitable energy-absorbing vaporizable material can also be used.

By using the water-filled plastic bags as an energy absorption means, it has been found that the instantaneous theoretical pressure of the explosion is reduced by more than half, and the introduction of moisture into the chamber at the moment of detonation and thereafter has a beneficial effect of suppressing dust and cooling the explosion products instantly. In practice, both the water and the plastic bags are completely vaporized, serving to absorb and suppress the undesired shock of the explosion, while leaving behind virtually no debris or residue.

In actual tests, it has been proven that the chamber of the illustrated preferred embodiment will withstand the detonation of up to 5.0 lb (2.7 kg) of C-2 plastic explosive on a repetitive basis without damage to the chamber or its fittings, and without any significant buildup of debris or blast residue. If the weapon 13 is known or suspected to contain explosives, a proportionately lesser mass of donor charge 16 is used, so that the maximum explosive load is kept within a safe range.

The mass of water to be used in the energy absorption modules has been found to be dependent upon the type of explosive to be detonated and its mass. Because the energy liberated per unit of explosive varies according to the type of explosive involved, for optimum blast suppression the mass ratio of water to explosive must also be varied. The following ratios have been determined to be substantially optimal for use with the types of explosives indicated:

| Explosive | Btu/lb | Water/Explosive Mass Ratio |
|---|---|---|
| HMX | 3,402 | 2.50 |
| RDX | 2,970 | 2.20 |
| PETN | 2,700 | 2.00 |
| C-2 | 1,700 | 1.25 |
| C-4 | 1,286 | 1.68 |
| TNT | 1,665 | 1.22 |

In another important aspect of the invention, known or suspected chemical and/or biological warfare (CBW) agents may be successfully destroyed using this chamber. For this purpose, the means for detonating is modified to assure that the explosion will create within the chamber a condition having an instantaneous pressure of 155 kilobars and high temperature of 4,000 degrees Celsius. A pressure of at least 100 kilobars and a temperature of at least 3,000 degrees Celsius is to be desired.

According to the invention, these conditions are created by the use of a specially formulated explosive which is oxygen-enriched and contains powdered metal to intensify and prolong the brief fireball resulting from the explosive. A suitable PETN-based plastic explosive such as C-4 is modified by the inclusion or addition of up to ten percent (10%) -by weight of an oxidizing material such as potassium nitrate, sodium nitrate or ammonium nitrate. A finely divided metal powder, preferably aluminum, magnesium or iron, is either added to the donor charge itself placed in a packet (not shown) next to the donor charge, so that its contents are consumed in the explosion and add to its temperature, pressure and duration. By this technique, the detonation of the donor charge creates a nearly instantaneous condition within the chamber which no known biological or neurological agent can withstand.

In tests, the utility and effectiveness of the present invention in destroying even CBW nerve agents has been verified. The readily available and easily handled organophosphous pesticide Malathion (TM) can be used as a surrogate for the extremely dangerous, but chemically very similar, nerve gas agents Sarin and VX. In an actual field tests of the above-described chamber, using 95% agricultural grade Malathion (S.G.=1.21) as a surrogate, the following results were obtained (all quantities are in ounces):

TEST RESULTS February 25, 1999

| Test No. | AL Oxide Sheet | C-4 | Total Charge | Water | Malathion | Chem/charge ratio |
|---|---|---|---|---|---|---|
| 1 | 12 | 4 | 16 | 12 | 4 | 1:4 |
| 2 | 12 | 4 | 16 | 12 | 4 | 1:4 |
| 3 | 8 | 4 | 12 | 12 | 4 | 1:3 |
| 4 | 8 | 0 | 8 | 12 | 4 | 1:2 |

For each test, a measured amount of 4.0 oz of Malathion was placed in the chamber as the weapon 13, together with a predetermined charge of C-4 plastic explosive, an fireball enhancement component consisting of AL Oxide, and a measured quantity of water contained in a plastic bag. The door to the chamber was then closed and sealed, and the explosive charge was electrically detonated. Each time, a short puff of explosion products, primarily water vapor, was observed issuing from the exhaust vent 11. On opening the door 6, a few remaining wisps of vapor were observed, but observers noted virtually no presence of the highly distinctive odor characteristic of Malathion, even in small quantities.

Two independent environmental testing companies, were engaged to observe the tests and to measure the residual concentration of Malathion remaining in the chamber after each explosion. The technicians wiped down 100 $cm^2$ areas of the chamber inside walls, the pea gravel bed, and the inside of the exhaust vent. Of the four tests, the highest concentration of Malathion noted was in Test 3, after the build-up of two preceding explosions, where a wipe from the inside of the chamber disclosed a residual Malathion concentration of only 0.092 micrograms per $cm_2$. Other readings from the same series of tests were an order of magnitude lower than that, and others even were below reliable detection limits.

A particular advantage of the explosion chamber of the present invention is that it is compact enough to be readily transported a truck or trailer to locations in the field for the disposal of all manner of explosive devices including suspected terrorist weapons. With a width of just over three feet, the chamber can be mounted on dolly wheels and rolled directly into buildings through an existing door opening, such as a revolving door with its door panels removed. A suspected bomb or other terrorist device can be placed into the chamber by a remote-controlled robot arm, or by an officer wearing protective gear. When the suspected device is positioned in the chamber next to a donor charge, detonator, and water bag, the door is simply closed and secured, and the donor charge is detonated from a safe distance. Whether the suspect device contains explosive, CBW agents, or both, it and the agents are quickly and safely disposed of with little danger to persons or property. The chamber can then be simply rolled back out of the building and returned to a safe location for cleaning and preparation for the next use.

Figure 5:
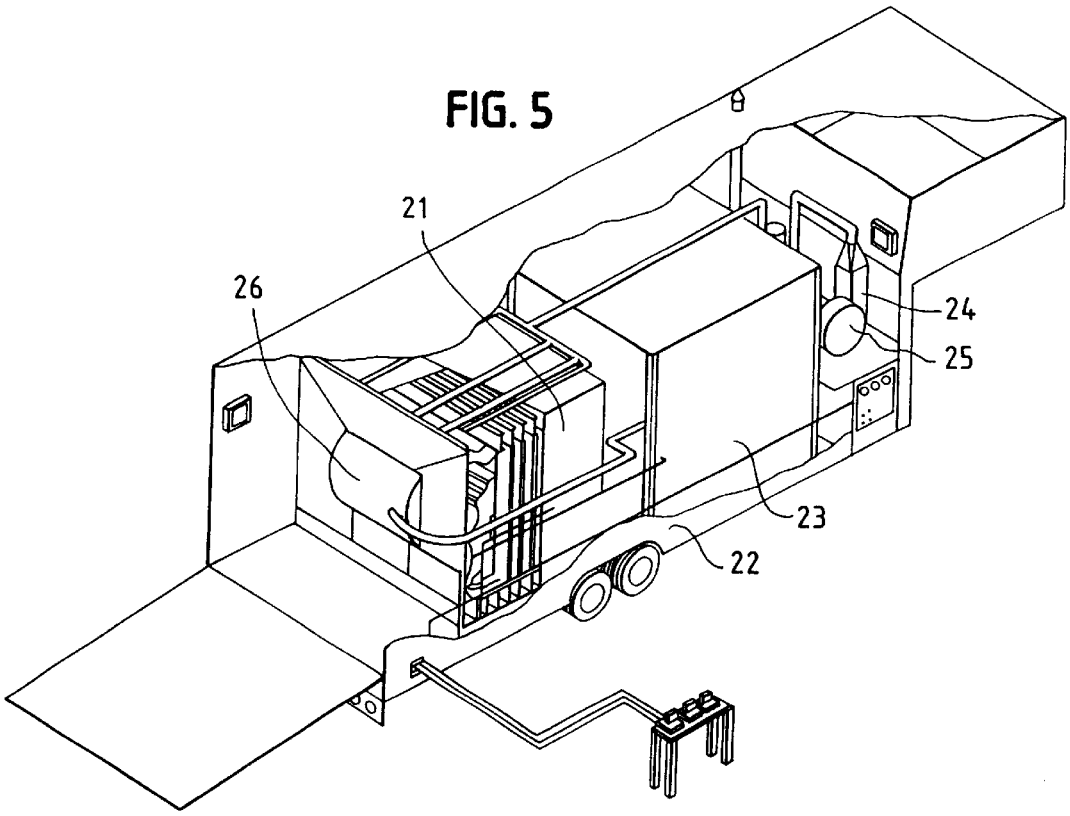
FIG. 5 is a partial sectional perspective view of the explosion chamber of the preceding figures employed as part of a mobile trailer-mounted unit for the controlled destruction of suspected explosive and CBW devices.

FIG. 5 shows a further modification of the invention intended for treatment of devices containing known CBW agents on a larger scale. In this embodiment, the chamber 21 is mounted on an enclosed trailer 22 adapted to be towed by a tractor unit (not shown). The trailer is equipped with a water-spray scrubber or other treatment means 23 of conventional construction coupled with a particulate separator 24 and an exhaust fan 25 to draw all explosion products out of the chamber after each detonation, so that no gaseous explosion products escape to the atmosphere untreated.

For extra safety, a secondary containment device comprising a hinged leak suppression hood 26 is positioned over the chamber access door opening to collect any leaked explosion products escaping through the door opening. A conduit is provided to convey any leaked explosion products to into the scrubber or other treatment means 23.

I claim:

1. A device for the destruction of weapons by explosion, comprising:

a pressure-resistant vessel having an inner casing and an outer casing surrounding and spaced from the inner casing, said inner casing defining an enclosed chamber having walls, a floor and a ceiling, with at least one door opening penetrating said casings and being closed by a sealable access door;

an external manifold;

a plurality of orifices penetrating the inner casing of said enclosed chamber, each said orifice being connected to the external manifold by a vent pipe;

spacer means for connecting the inner and outer casings to define a plurality of cavities substantially surrounding the enclosed chamber, with each said cavity being substantially filled with a granular shock-damping material;

the floor of said enclosed chamber being substantially covered with a layer of granular shock-damping material;

means for detonating said weapon comprising a donor charge of explosive sufficient to destroy the weapon, ignition means for detonating the donor charge;

at least one liquid-filled energy absorption module in proximity to said donor charge and weapon; and disintegratable support means within the enclosed chamber for suspending said donor charge, weapon, and at least one liquid-filled energy absorption module above the chamber floor at about the midpoint of the chamber.

2. The device of claim 1 in which the energy absorption modules comprise vaporizable containers filled with water.

3. The device of claim 2 in which the mass of water in the vaporizable containers is selected to modulate the instantaneous peak pressure of a detonation of the donor charge and weapon to a level which said pressure-resistant vessel is capable of withstanding repeatedly.

4. The device of claim 1 in which the granular energy-absorbing material filling the cavities is silica sand.

5. The device of claim 1 in which the granular energy-absorbing material covering the floor is pea gravel.

6. The device of claim 1 in which said disintegratable support means consists of a material which will be substantially consumed by the detonation of the donor charge and weapon.

7. The device of claim 6 in which the disintegratable support means is a mesh made of a material selected from the group consisting of natural organic fiber, polymer monofilament, and fine metallic wire.

8. The device of claim 1 in which the external manifold is connected to testing means for detecting and measuring toxic residues in said explosion products, and treatment means for removal of such toxic residues before the release of said explosion products to the environment.

9. The device of claim 8 further including a removable external leak suppression hood positioned over the door opening to collect leaked explosion products escaping from the chamber around the door through the door opening, and conduit means for conveying said leaked explosion products to the testing means and treatment means.

10. The device of claim 1 in which the donor charge consists of an augmented high-energy explosive which, when detonated, will create within said chamber a pressure of at least 100 kilobars and a temperature of at least 3,000 degrees Celsius.

11. The device of claim 1 in which the means for detonating said weapon further includes:

an oxygen-enrichment ingredient selected from the group consisting of potassium nitrate, sodium nitrate, and ammonium nitrate; and a fireball-enhancement ingredient selected from the group consisting of aluminum, magnesium, and iron, said ingredient being in the form of a finely divided powder.

12. The device of claim 1 in which the donor charge comprises an enriched plastic explosive containing a primary energetic ingredient selected from the group consisting of PETN, RDX, HMX, C-2, C-4 and TNT;

an oxygen-enrichment ingredient selected from the group consisting of potassium nitrate, sodium nitrate, and ammonium nitrate; and a fireball-enhancement ingredient selected from the group consisting of aluminum, magnesium, and iron, said ingredient being in the form of a finely divided powder.

13. The device of claim 1 in which the energy absorption modules comprise vaporizable containers filled with water, and the mass of water in the vaporizable containers is selected to match the energetic mass of the donor charge.

14. The device of claim 13 in which the mass of water in the energy absorption modules is chosen from the following table according to the principal explosive component of the donor charge:

| Explosive | Btu/lb | Water/Explosive Mass Ratio |
|---|---|---|
| HMX | 3,402 | 2.50 |
| RDX | 2,970 | 2.20 |
| PETN | 2,700 | 2.00 |
| C-2 | 1,700 | 1.25 |
| C-4 | 2,286 | 1.68 |
| TNT | 1,665 | 1.22 |

15. The method for the destruction of weapons by explosion, comprising:

providing a pressure-resistant vessel having an inner casing and an outer casing surrounding and spaced from the inner casing, said inner casing defining an enclosed chamber having walls, a floor and a ceiling, with at least one door opening penetrating said casings and being closed by a sealable access door;

an external manifold;

a plurality of orifices penetrating the inner casing of said enclosed chamber, each said orifice being connected to the external manifold by a vent pipe;

spacer means for connecting the inner and outer casings to define a plurality of cavities substantially surrounding the enclosed chamber, with each said cavity being substantially filled with a granular shock-damping material;

the floor of said enclosed chamber being substantially covered with a layer of granular shock-damping material covering;

placing a weapon within said chamber along with means for detonating said weapon comprising a donor charge of explosive sufficient to destroy the weapon, ignition means for detonating the donor charge, and at least one liquid-filled energy absorption module in proximity to said donor charge and weapon;

suspending said donor charge, weapon, and at least one liquid-filled energy absorption module with a disintegratable support means above the chamber floor at about the midpoint of the chamber;

closing and sealing the chamber door; and detonating said donor charge.

16. The method of claim 15 in which the energy absorption modules comprise vaporizable containers filled with water.

17. The method of claim 15 in which the mass of water in the vaporizable containers is selected to modulate the instantaneous peak pressure of a detonation of the donor charge and weapon to a level which said pressure-resistant vessel is capable of withstanding repeatedly.

18. The method of claim 15 in which the granular energy-absorbing material filling the cavities is silica sand.

19. The method of claim 15 in which the granular energy-absorbing material covering the floor is pea gravel.

20. The method of claim 15 in which said disintegratable support means consists of a material which will be substantially consumed by the detonation of the donor charge and weapon.

21. The method of claim 20 in which the disintegratable support means is a mesh made of a material selected from the group consisting of natural organic fiber, polymer monofilament, and fine metallic wire.

22. The method of claim 15 including the further steps of measuring for toxic residues in the explosion products exiting the external manifold, and treating such toxic residues to render them harmless before they are released into the environment.

23. The method of claim 15 in which the donor charge consists of an augmented high-energy explosive which, when detonated, will create within said chamber a pressure of at least 100 kilobars and a temperature of at least 3,000 degrees Celsius.

24. The method of claim 15 in which the means for detonating said weapon further includes:

an oxygen-enrichment ingredient selected from the group consisting of potassium nitrate, sodium nitrate, and ammonium nitrate; and a fireball-enhancement ingredient selected from the group consisting of aluminum, magnesium, and iron, said ingredient being in the form of a finely divided powder.

25. The method of claim 15 in which the donor charge comprises an enriched plastic explosive containing a primary energetic ingredient selected from the group consisting of PETN, RDX, HMX, C-2, C-4 and TNT;

an oxygen-enrichment ingredient selected from the group consisting of potassium nitrate, sodium nitrate, and ammonium nitrate, and a fireball-enhancement ingredient selected from the group consisting of aluminum, magnesium, and iron, said ingredient being in the form of a finely divided powder.

26. The method of claim 15 in which the energy absorption modules comprise vaporizable containers filled with water, and the mass of water in the vaporizable containers is selected to match the energetic mass of the donor charge.

27. The method of claim 26 in which the mass of water in the energy absorption modules is chosen from the following table according to the principal explosive component of the donor charge:

| Explosive | Btu/lb | Water/Explosive Mass Ratio |
|---|---|---|
| HMX | 3,402 | 2.50 |
| RDX | 2,970 | 2.20 |
| PETN | 2,700 | 2.00 |
| C-2 | 1,700 | 1.25 |
| C-4 | 2,286 | 1.68 |
| TNT | 1,665 | 1.22 |

* * * * *